United States Patent [19]

Ostreng

[11] 4,177,954

[45] Dec. 11, 1979

[54] HAMMER-ROLL RECYCLING PLANT

[76] Inventor: Arlen J. Ostreng, Rte. 3, Robill Ct., Box 627, LaCrosse, Wis. 54601

[21] Appl. No.: 870,064

[22] Filed: Jan. 17, 1978

Related U.S. Application Data

[63] Continuation-in-part of Ser. No. 771,013, Mar. 8, 1977, abandoned.

[51] Int. Cl.[2] ..... B02C 13/28

[52] U.S. Cl. ..... 241/167; 241/189 R; 241/193

[58] Field of Search ..... 241/189 R, 189 A, 193, 241/196, 167

[56] References Cited

U.S. PATENT DOCUMENTS

| | | | |
|---|---|---|---|
| 1,683,304 | 9/1928 | Roebke | 241/196 X |
| 1,892,697 | 1/1933 | Elzemeyer et al. | 241/196 X |
| 2,339,628 | 1/1944 | Feight | 241/193 |
| 3,637,145 | 1/1972 | Williams | 241/189 A |

FOREIGN PATENT DOCUMENTS

| | | | |
|---|---|---|---|
| 479487 | 11/1975 | U.S.S.R. | 241/189 R |

*Primary Examiner*—Howard N. Goldberg

*Attorney, Agent, or Firm*—Williamson, Bains, Moore & Hansen

[57] ABSTRACT

A rotor is mounted rotatably in a housing. A plurality of hammer cylinders are rotatably mounted on the rotor and are radially spaced from the axis of rotation of the rotor as well as being equidistantly circumferentially spaced from each other. Hammer cylinders crush concrete to be recycled against a plurality of breaker cylinders which are yieldably mounted for protection against ingestion of uncrushables. The rotatable mounting of the various cylinders insures that a fresh surface will continuously be presented in order to spread the wear due to impact over the entire surface of the cylinder.

8 Claims, 4 Drawing Figures

HAMMER-ROLL RECYCLING PLANT

CROSS REFERENCE TO RELATED APPLICATIONS

This application is a continuation in part of Ser. No. 771,013 filed Mar. 8, 1977, now abandoned.

BACKGROUND OF THE INVENTION

This invention deals with apparatuses for particularly the crushing of concrete and the like. In recent years, it has become desirable to recycle concrete after demolition of existing roads, structures and the like. In general none of the existing crushing machines adequately serve to produce the desired result of crushing concrete economically, expeditiously and with low maintenance and operating cost. Prior art devices have been of several types. In general they comprise a rotor having various structures mounted upon which serve to crush the articles to be crushed such as rock or metal against a relatively stationary grate or array of rotors. Particularly the structures mounted on the rotor have fallen into one of two categories. The first is that of the so-called hammer wherein essentially an elongated bar is fixedly mounted to the rotor for performing the crushing operation. The problem with this type of machine is that such a bar quickly wears away thereby requiring frequent replacement with the attendant down time and cost. The other prior art device has a plurality of shafts radially spaced from the axis of rotation of the rotor, and upon these shafts are mounted a plurality of relatively narrow rings. These rings typically have an inside diameter several times larger than the outer diameter of the shaft upon which they are mounted with the result that the rings rattle and flop around on the shaft. In a highly stressed operation such as concrete crushing this flopping about under the crushing operation produces severe impact stresses in the shaft upon which they are mounted and render such an arrangement decidedly unsuitable for the crushing of concrete. Also in general since these rings are relatively narrow compared to their diameter, in general a plurality of these rings are placed between supports of the shaft. Thus this flopping about additionally produces severe shear and bending stresses on the shaft.

In the device of the instant invention this general scheme is followed except that mounted upon the shafts are a plurality of cylinders which are quite long in relation to their diameter, typically a 24-inch length with an 8-inch diameter. A plurality of these cylinders are rotatably mounted on a corresponding plurality of shafts spaced about the periphery of a rotatably mounted rotor. The hammer cylinders are mounted with a close sliding fit over their corresponding shafts such that substantially no translational movement is allowed of the cylinder relative to the rotor and the only movement thereby allowed in such an arrangement is rotational. Such an arrangement has several advantages. First, since the clearance between the shaft in the bore of the cylinder is minimal, impact of the hammer cylinder against the shaft is substantially eliminated. Also since the cylinder is relatively long and extends completely between rotor plates the bending moments caused by crushing are relatively small in comparison to those of the typical ring set up. In such an arrangement the length of the cylinder actually serves to effectively support and strengthen the shaft located therein and prevent any bending from occurring. Also such an arrangement serves to equalize the wear on the cylinders such that a cylinder, once in place, may be left in the machine for a long period of time and without removal or service. In the crushing of materials against a breaker assembly the outer face of the cylinder is continually worn thereby creating a light spot on the cylinder and correspondingly a heavy spot diametrically opposite. The rotation of the rotor produces a centrifugal force which serves to throw the heavy side of the cylinder into the outermost position thereby presenting a fresh, less worn surface for impacting.

A plurality of breaker cylinders are rotatably mounted on an arcuate shaped breaker bar mounting frame. Ideally the breaker cylinders are identical to the hammer cylinders such that only one part need be stocked for replacement purposes. These cylinders are rotatably mounted with a relatively close fit similar to the hammer cylinders and serve to provide a surface against which the hammer cylinders crush the concrete. This crushing occurs in two ways in that concrete when initially fed into the machine will be flung against the breaker cylinders by the rotor providing initial fracturing. These smaller pieces then subsequently fall between lower breaker cylinders and the hammer cylinders proper for final crushing. The breaker frame assembly is pivotably mounted at the top thereof and is yieldably located at its midpoint by a preloaded spring assembly. Occasionally non-crushable material such as concrete reinforcing rod and the like is ingested in the machine and in order to prevent shearing of the shafts or other damage upon the attempted crushing of these materials the breaker assembly is mounted to yield to a predetermined force which is provided by a preload on the spring assembly. These and other objects and advantages of my invention will appear more fully from the following description made in conjunction with the accompanying drawings wherein like reference characters refer to the same or similar parts throughout the several views.

DESCRIPTION OF THE PREFERRED EMBODIMENT

Figure 1:
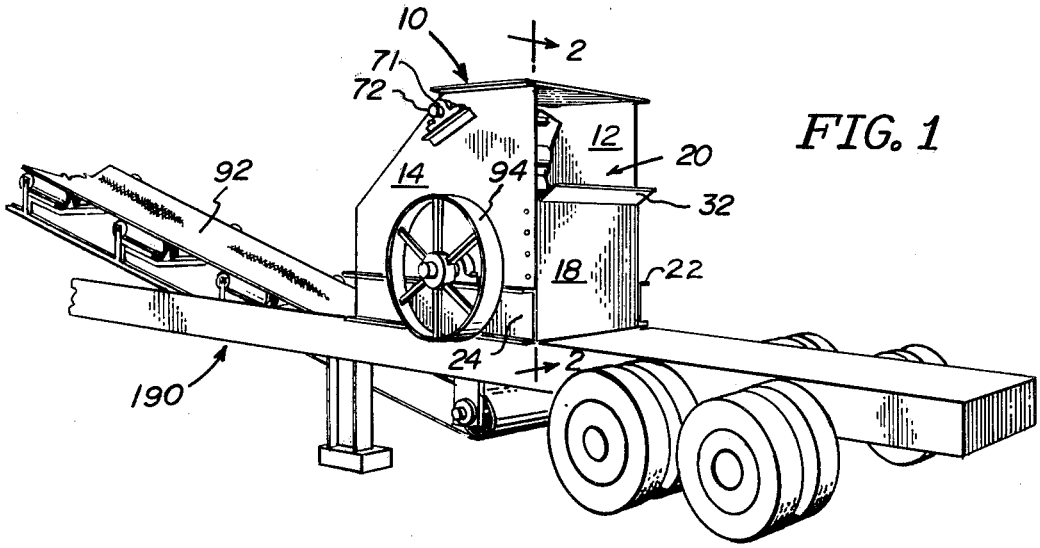
FIG. 1 is a perspective view of the recycling plant as mounted on a trailer for portable use.

A concrete crushing device generally designated 10 comprises generally two side walls 12 and 14, a top 16 and a front wall 18. Front wall 18 extends only partially the height of the device to provide a feed opening 20. Channel section beams 22 and 24 are provided at the bottom of side walls 12 and 14 respectively for the reinforcement of the device. A rear wall may be provided and like front wall 18 extends only partially the height of the device. An upper sloping rear wall may be utilized if desired to conserve space and materials, although rear wall 26 may extend to the juncture of top wall 16. Another channel member 30 horizontally extends across the top of the rear end and is affixed thereto for reinforcing and mounting the spring mounting as will be more fully discussed hereinafter. The feed flange 32 is disposed across the top of front wall 18 and slopes downwardly inwardly into the crushing device. Flange 32 assists in directing the inward flow of materials to be crushed and additionally serves a reinforcing function. Bearings 34 and 36 are mounted at top side rails 22 and 24 respectively. Rotor shaft 38 extends through bearing 34, side wall 12 across interior cavity 40 and hence through side wall 14 and bearing 36. Collars 42 are located outboard of bearings 34 and 36 on shaft 38 and serve to axially locate shaft 38 in the device. Two rotor frames 44 are circular in shape and are mounted inside cavity 40 adjacent side walls 12 and 14. Frames 44 are mounted to shaft 38 using conventional keys 48. A center frame piece 46 located at the center of cavity 40 and shaft 38 is identical in structure to frames 44 and is mounted in the same fashion using a key 48. A plurality of hammer cylinders 62 are mounted on shaft 60 which are in turn mounted through rotor frames 44 and 46. It has been envisioned that a standard size cylinder may be used for any size machine with only the number and arrangement of those cylinders varying. Specifically the embodiment shown herein makes use of two hammer cylinders 62 disposed along the length of each hammer cylinder shaft 60 with the center rotor frame 46 disposed between. As would be obvious to one skilled in the art this arrangement could be repeated to form larger machines merely by the addition of more hammer cylinders and rotor frames. Also in the device of the instant embodiment four hammer cylinder shafts 60 are equidistantly circumferentially spaced about rotor frames 44 and 46. This of course may also be subject to modification. Hammer cylinders 62 are rotatably mounted on hammer cylinder shaft 60 such that a minimal clearance is provided. This arrangement only allows the cylinders to rotate upon the shaft but does not allow any substantial translational movement relative to the shaft. This same sliding fit is also used for mounting hammer cylinder shaft 60 in rotor frames 44 and 46. This clearance may be on the order of a few thousandths and although hammer cylinder shafts 60 may be located with a collar (not shown) located outboard of rotor frames 44, preferably no such device is used as the side walls 12 and 14 will act to confine hammer cylinder shafts 60 in its desired position.

A breaker bar assembly generally 63, is pivotably mounted within housing 11. Breaker assembly 63 comprises several arcuate members 66 located parallel to one another and spaced apart and joined on their rear sides by breaker rear wall 64. Mounted in breaker assembly 63 are breaker cylinders 70 in a fashion similar to that of the hammer cylinders. Specifically breaker cylinders 70 are mounted upon breaker cylinder shaft 68 which extend through arcuate members 66 in a fashion similar to which hammer cylinder shafts 60 extend through rotor frames 44 and 46. That is, breaker cylinders 70 are rotatably mounted with a light clearance fit upon breaker cylinder shafts 68 which are in turn mounted with a light sliding fit in arcuate member 66. Breaker cylinder shafts 68 are retained in a similar fashion in that the side walls 12 and 14 serve to confine shafts 68 in their proper positions. Breaker assembly 63 is pivotably mounted at its upper end by means of breaker assembly shaft 72 which passes consecutively through housing side wall 12, arcuate member 66 and hence through housing side wall 14. Bearing 71 may be located if desired on housing side walls 12 and 14 to rotatably support breaker assembly shaft 72.

Figure 2:
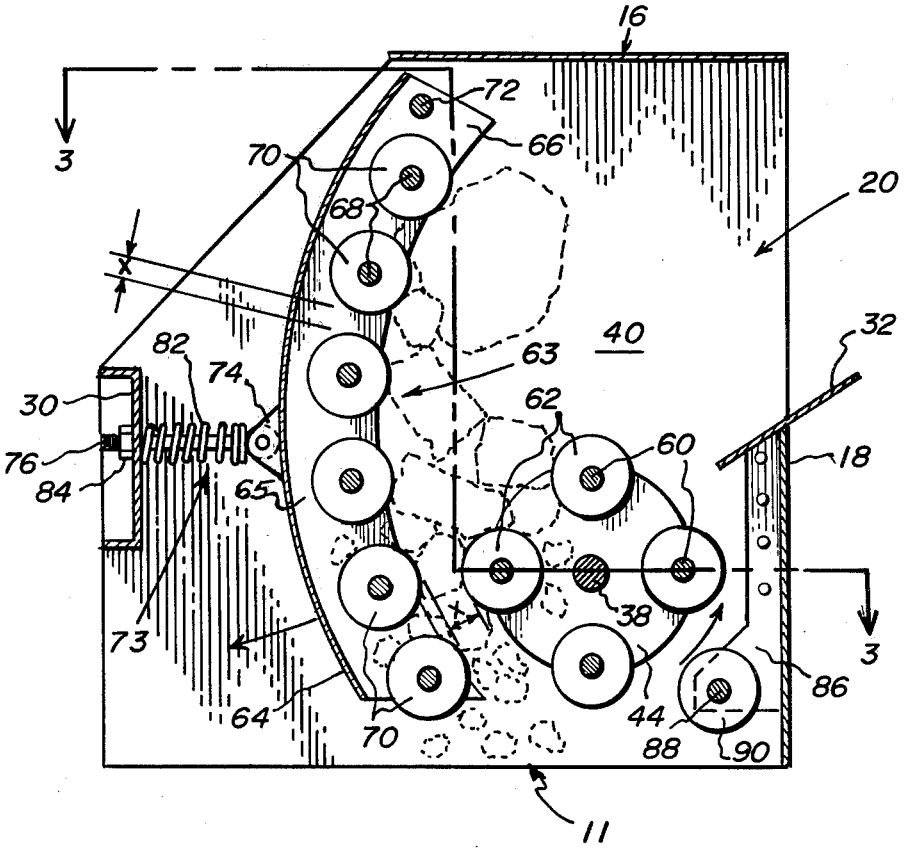
FIG. 2 is a vertical sectional view taken along lines 2—2 of FIG. 1.
Figure 3:
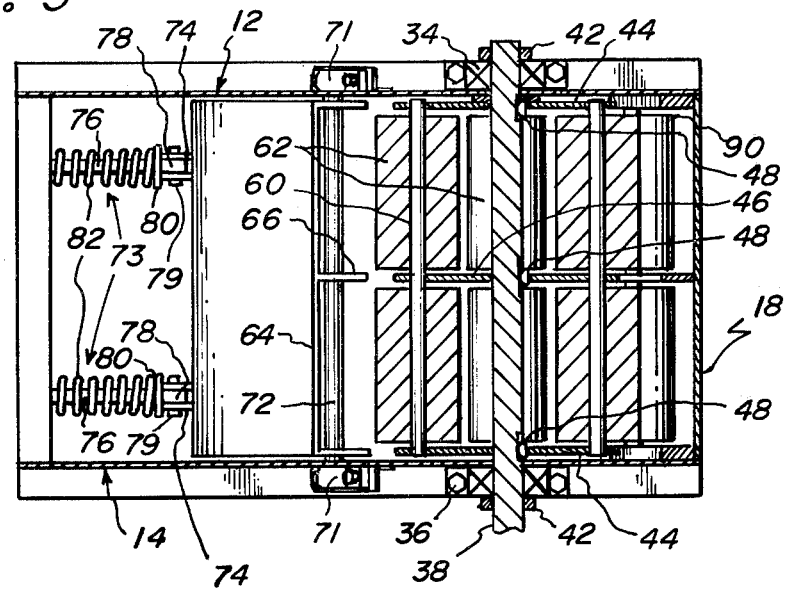
FIG. 3 is a horizontal sectional view taken along lines 3—3 of FIG. 2.
Figure 4:
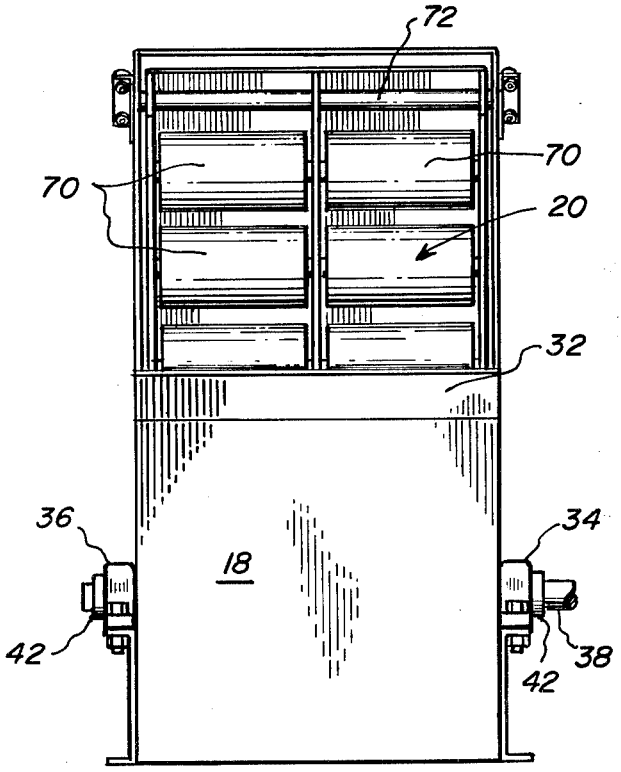
FIG. 4 is a plan view looking at the front wall of the recycling plant.

Breaker assembly 63 is located a predetermined distance X away from the outermost periphery of the hammer cylinders 62 as shown in FIG. 2. Predetermined distance X represents the maximum size of the finished crushed material. This dimension X also represents the spacing between the outer surfaces of breaker cylinders 70 as shown also in FIG. 2. A plurality of flanges 74 are affixed to rear wall 64 of breaker assembly 63. Flanges 74 serve to mount in position the release assembly 73. Release assembly 73 comprises a threaded eye bolt 76 having at one end an eye 78 and adjacent thereto flange 80. Located concentrically about eye bolt 76 and between flange 80 and channel member 30 is release spring 82. Eye 78 is located between two of flanges 74 by fastener 79 which may be of any conventional sort. A nut 84 is threaded onto the end of eye bolt 76 and abutts the outward side of channel member 30. Nut 84 is threaded on eye bolt 76 and tightened until spring 82 is preloaded to a load of, preferably, 10,250 pounds. This figure yields good results and the spring will come into play and compress only when an uncrushable material such as concrete reinforcing rod or the like is ingested into the machine. This preload prevents movement of the breaker assembly though in a normal concrete crushing operation. A scraper roller 90 is mounted on a scraper roller shaft 88 between scraper mounting plates 86. The mounting is done in the same fashion as that used to mount the hammer cylinders and the breaker cylinders, with shaft 88 being restrained by side walls 12 and 14. Scraper cylinder 90 acts to prevent crushed materials from being carried back up into cavity 40 upon rotation of rotor 44. Mounting plates 86 are affixed to front wall 18 of the crusher.

If so desired for portable operation, recycling plant 10 may be mounted upon a trailer 190 as shown in FIG. 1 and a conveyor 92 utilized to carry off the crushed materials. Further a pulley 94 is used to connect shaft 38 to a desired source of power for the device. Such source of power may be any well known source of power such as a diesel engine or the like.

In operation of the invention large pieces of concrete to be crushed are fed through feed opening 20 in the front of the machine. Rotor 44 with hammer cylinder 60 mounted thereon is rotated at a speed preferably in the range of 650–700 rpm. As the pieces of concrete are fed through opening 20 they fall onto the whirling rotor and cylinder assembly and are hurled in the direction of breaker assembly 63 whereupon due to the speed imparted by the whirling rotor a substantial amount of cracking and crumbling takes place thereby serving to initially break down the concrete to be recycled. Breaker cylinders 70 are spaced apart a distance X, preferably two inches, which represents the preferable maximum size of the finished crushed product. Should sufficient crushing take place on this initial impact certain portions of the crushed material will fall through passage 65 which is formed by back wall 64 of the breaker assembly 63 and by the breaker cylinders 70. This passage is at least as wide as the predetermined finished dimension X. Any material that has not assumed this finished size will fall downwardly into the crushing zone formed by the confrontation of the lower rollers of breaker cylinders 70 and rotating hammer cylinders 62. The rotating action of hammer cylinders 62 against breaker cylinders 70 serve to crush and pulverize the material to the desired predetermined finished dimension X. The clearance between breaker cylinders 70 and hammer cylinders 62 is generally this predetermined dimension X, preferably two inches. Typically the cylinders of the instant invention are eight inches in diameter. Should any non-crushable material such as, for instance, concrete reinforcing rod be fed into the machine, the release assembly 73 will be compressed allowing breaker assembly 63 to swing toward the rear wall 26 of the apparatus thereby preventing damage to various other portions of the machine. Breaker assembly 63 pivots about breaker pivot shaft 72 located at the top of the machine. Upon the non-crushable material's passage through the machine release assembly 73 returns the breaker assembly 63 to its original position.

A scraper cylinder 90 is located adjacent front wall 18 in the machine and has a minimal clearance with the periphery of rotating hammer cylinders 62. Thus scraper cylinders 90 serve to prevent materials once crushed from being carried back up into the crushing cavity 40.

An important feature of the instant invention resides in the provision of the freely rotatable cylinders for all functions. Essentially the importance of this free rotation allows, unlike hammer type devices, the use of a fresh impacting surface continuously. This function also serves to provide even wear on the cylinders so as to make such cylinders much longer lasting than the previous mentioned hammer type machines. As hammer cylinders 62 are worn through impacting, a worn portion forms on the outer side of a particular cylinder thus making that side of the cylinder lighter in comparison to the rest. As rotor 44 rotates, the centrifugal force forces the opposite side of each particular hammer cylinder, that is, the heavier part to rotate to the outside or crushing position. Thus as the machine operates hammer cylinders 62 are continuously worn and then automatically rotate to present the freshest surface, that is the heaviest surface on the cylinder to the crushing position. Thus a substantial amount of wear can be spread over the entire circumference of the cylinder. Similarly, breaker cylinders 79 operate in a similar fashion. As the face of cylinders 70 facing crushing cavity 40 are worn that face becomes lighter and rotates upwardly thereby allowing a fresh or heavier face to come into position. As with the hammer cylinders this process is also continual and also allows the wear to be spread over the entire cylinder.

While the preferred embodiments of the present invention have been described, it should be understood that various changes, adaptations and modifications may be made therein without departing from the spirit of the invention and the scope of the appended claims.

What is claimed is:

1. An apparatus for crushing reinforced concrete and the like comprising:

a housing;

a rotor rotatably mounted within said housing and having an axis of rotation;

means for rotating said rotor;

a plurality of hammer cylinders;

means for rotatably mounting said hammer cylinders to said rotor so that no translational movement of the cylinder relative to the rotor is permitted;

said mounting means comprising a plurality of shafts fixed to said rotor assembly, each of said shafts having a longitudinal axis parallel to the axis of rotation of said rotor, said plurality of shafts being substantially equidistantly spaced circumferentially about said rotor;

each of said hammer cylinders having a length at least as great as its diameter;

a breaker bar assembly mounted to said housing a predetermined distance from said rotor and said hammer cylinders;

said hammer cylinders being rotatably mounted on said shafts with a sliding fit allowing only rotational movement of said hammer cylinders relative to said rotor.

2. The apparatus of claim 1 wherein said breaker bar assembly comprises a breaker frame, a plurality of breaker cylinders and means for rotatably mounting said breaker cylinders to said breaker frame, said breaker cylinders having an axes of rotation substantially parallel to the axis of rotation of said rotor.

3. The apparatus of claim 2 wherein each of said breaker cylinders has a length at least as great as its diameter.

4. The apparatus of claim 3 wherein said breaker cylinder mounting means comprises a plurality of breaker shafts fixed to said breaker frame, said breaker cylinders being rotatably mounted on said breaker shafts with a sliding fit allowing only rotational movement relative to said frame so as to minimize impact resulting from translational movement of said breaker cylinders relative to said frame.

5. The apparatus of claim 2 wherein said breaker assembly is mounted to said housing with release means for momentarily increasing said predetermined distance in response to a predetermined force being exerted on said breaker assembly by a non-crushable material.

6. The apparatus of claim 5 wherein said breaker assembly is pivotably mounted at the top of said housing and said release means comprises a spring biasing said assembly towards said rotor and having a preload of said predetermined force.

7. The apparatus of claim 1 further comprising means for scraping said hammer cylinders of extraneous material on each rotation after the crushing operation and preventing any such material from being retained on said hammer cylinders.

8. The apparatus of claim 7 wherein said scraping means comprises at least one scraping cylinder rotatably mounted to said housing parallel to said hammer cylinders and on the opposite side of said rotor from said breaker assembly, the circumference of said scraping cylinder being adjacent the circumference of said hammer cylinders and having a clearance therebetween small enough to prevent the passage of a reinforcing rod therethrough.

* * * * *